US009816345B2

(12) United States Patent
Freeman et al.

(10) Patent No.: US 9,816,345 B2
(45) Date of Patent: Nov. 14, 2017

(54) CABLE WRAPPED INFLATABLE PACKER ELEMENT

(71) Applicant: TAM INTERNATIONAL, INC., Houston, TX (US)

(72) Inventors: David Freeman, Houston, TX (US); Caleb Kelley, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 302 days.

(21) Appl. No.: 14/630,240

(22) Filed: Feb. 24, 2015

(65) Prior Publication Data

US 2015/0240588 A1 Aug. 27, 2015

Related U.S. Application Data

(60) Provisional application No. 61/943,771, filed on Feb. 24, 2014.

(51) Int. Cl.
*E21B 33/127* (2006.01)

(52) U.S. Cl.
CPC ..... *E21B 33/1277* (2013.01); *Y10T 29/4981* (2015.01)

(58) Field of Classification Search
CPC ..... E21B 33/1277; E21B 33/1208; E21B 33/1216; E21B 33/127; Y10T 29/4981
USPC ..... 166/179
See application file for complete search history.

(56) References Cited

U.S. PATENT DOCUMENTS

| | | | | |
|---|---|---|---|---|
| 2,643,722 | A | 6/1953 | Lynes et al. | |
| 4,614,346 | A | 9/1986 | Ito | |
| 5,205,567 | A * | 4/1993 | Quinlan | F16L 11/083 166/187 |
| 5,361,836 | A | 11/1994 | Sorem et al. | |
| 5,778,982 | A | 7/1998 | Hauck et al. | |
| 2004/0216871 | A1 | 11/2004 | Mendez | |

OTHER PUBLICATIONS

International Search Report and Written Opinion issued in International Patent Application No. PCT/US2015/017325, dated May 28, 2015 (6 pages).
Extended European Search Report issued in EP Patent Application No. 15752336.6, dated Sep. 29, 2017 (9 pages).

* cited by examiner

*Primary Examiner* — Taras P Bemko
(74) *Attorney, Agent, or Firm* — Adolph Locklar

(57) ABSTRACT

A downhole packer element includes an inner and outer cable wrapped layer positioned about an inflatable bladder. The inner and outer cable wrapped layers are formed from helically wrapped, parallel cables. The inner cable wrapped layer may be wrapped about a layer of slats. The outer cable wrapped layer may be surrounded by an outer cover. An end sub may serve to couple the downhole packer element to a mandrel.

18 Claims, 4 Drawing Sheets

CABLE WRAPPED INFLATABLE PACKER ELEMENT

CROSS-REFERENCE TO RELATED APPLICATIONS

This application is a non-provisional application which claims priority from U.S. provisional application No. 61/943,771, filed Feb. 24, 2014, which is incorporated by reference herein in its entirety.

TECHNICAL FIELD/FIELD OF THE DISCLOSURE

The present disclosure relates generally to wellbore isolation devices, and specifically to elements for inflatable packers.

BACKGROUND OF THE DISCLOSURE

Fluid-energized, or inflatable, packers are isolation devices used in a downhole wellbore to seal against the inside of the wellbore or a downhole tubular to separate the section of wellbore or tubular on one side of the inflatable packer from that on the other side of the inflatable packer. Inflatable packers use elastic bladders positioned on the outside of a mandrel which, in response to an increased pressure within the bladder, expand until they contact the surrounding wellbore or tubular. Continued expansion causes an increase in contact area and force between the bladder and the wellbore or tubular, thereby sealing the annular space around the packer.

SUMMARY

The present disclosure provides for an inflatable packer for use in a wellbore. The inflatable packer may include a mandrel, the mandrel being generally tubular about an axis; a bladder, the bladder being generally tubular and formed from an elastomer, the bladder positioned about the mandrel and forming a space between the mandrel and the bladder defining the interior of the inflatable packer; a slat layer, the slat layer including a plurality of slats overlapping about the outer surface of the bladder; an inner cable wrapped layer, the inner cable wrapped layer including a plurality of inner cables wrapped around the slat layer; an outer cable wrapped layer, the outer cable wrapped layer including a plurality of outer cables wrapped around the outer diameter of the inner cable wrapped layer.

The present disclosure also provides for an inflatable packer element for use in a wellbore. The inflatable packer element may include a bladder, the bladder being generally tubular and formed from an elastomer; a slat layer, the slat layer including a plurality of slats, generally parallel and overlapping about the outer surface of the bladder; an inner cable wrapped layer, the inner cable wrapped layer including a plurality of inner cables wrapped around the slat layer generally parallel to each other; an outer cable wrapped layer, the outer cable wrapped layer including a plurality of outer cables wrapped around the outer diameter of the inner cable wrapped layer generally parallel to each other; the bladder, inner cable wrapped layer, and outer cable wrapped layer coupled to each other at the ends of the bladder, inner cable wrapped layer, and outer cable wrapped layer.

The present disclosure also provides for a method of manufacturing an inflatable packer element for use in a wellbore. The method may include providing a generally tubular temporary forming mandrel, the temporary forming mandrel having an axis; coupling a plurality of slats about the temporary forming mandrel, the slats being generally thin strips of metal, the slats positioned generally parallel and overlapping about the outer surface of the bladder; wrapping a plurality of inner cables about the slats to form an inner cable wrapped layer, the inner cables wrapped generally helically and parallel to each other and at a first angle relative to the axis of the temporary forming mandrel; wrapping a plurality of outer cables about the inner cable wrapped layer to form an outer cable wrapped layer, the outer cables wrapped generally helically and parallel to each other and at a second angle relative to the axis of the temporary forming mandrel, the second angle being generally the opposite of the first angle; positioning an end sub about each end of the inflatable packer element; coupling the end sub to the slats, inner cable wrapped layer, and outer cable wrapped layer; removing the temporary forming mandrel; positioning a bladder within the slats, the bladder being a generally tubular elastomer; sealing the bladder to the end sub.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
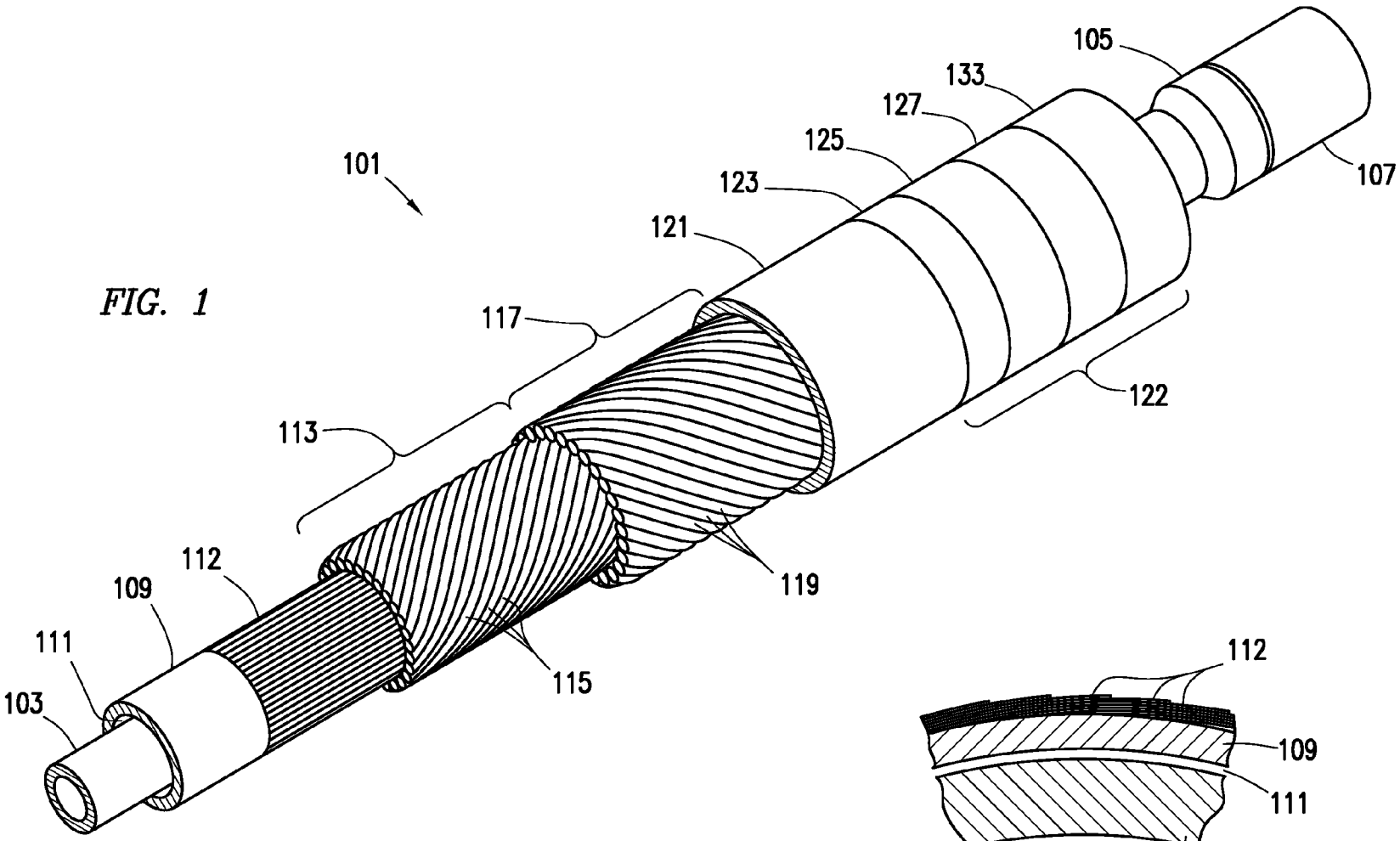
FIG. 1 depicts a cut-away isometric view of a cable wrapped inflatable packer element consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIGS. 1-4, inflatable packer 101 may include mandrel 103. Mandrel 103 is a generally tubular body having an interior and extending the length of inflatable packer 101. Mandrel 103 may include coupling 105 at one or both of its ends positioned to, for example, couple inflatable packer 101 to adjacent tubular member 107 to, for example, make up part of a tool string. In some embodiments, bladder 109 may be positioned about mandrel 103. Bladder 109 may be a generally tubular, elastomeric member positioned with a gap between its inner surface and mandrel 103, the gap forming interior cavity 111 of inflatable packer 101. Bladder 109 may be sealed to mandrel 103 such that when fluid pressure within interior cavity 111 increases, bladder 109 inflates and moves radially outward from mandrel 103.

Figure 1A:
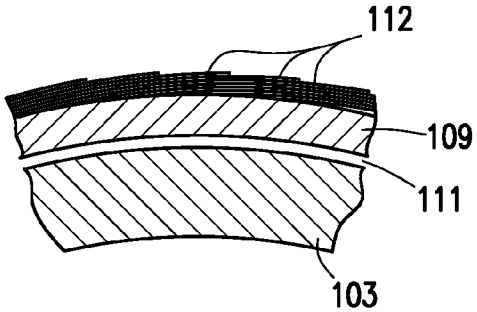
FIG. 1A depicts a cross section view of the slats of the cable wrapped inflatable packer element of FIG. 1.
Figure 2:
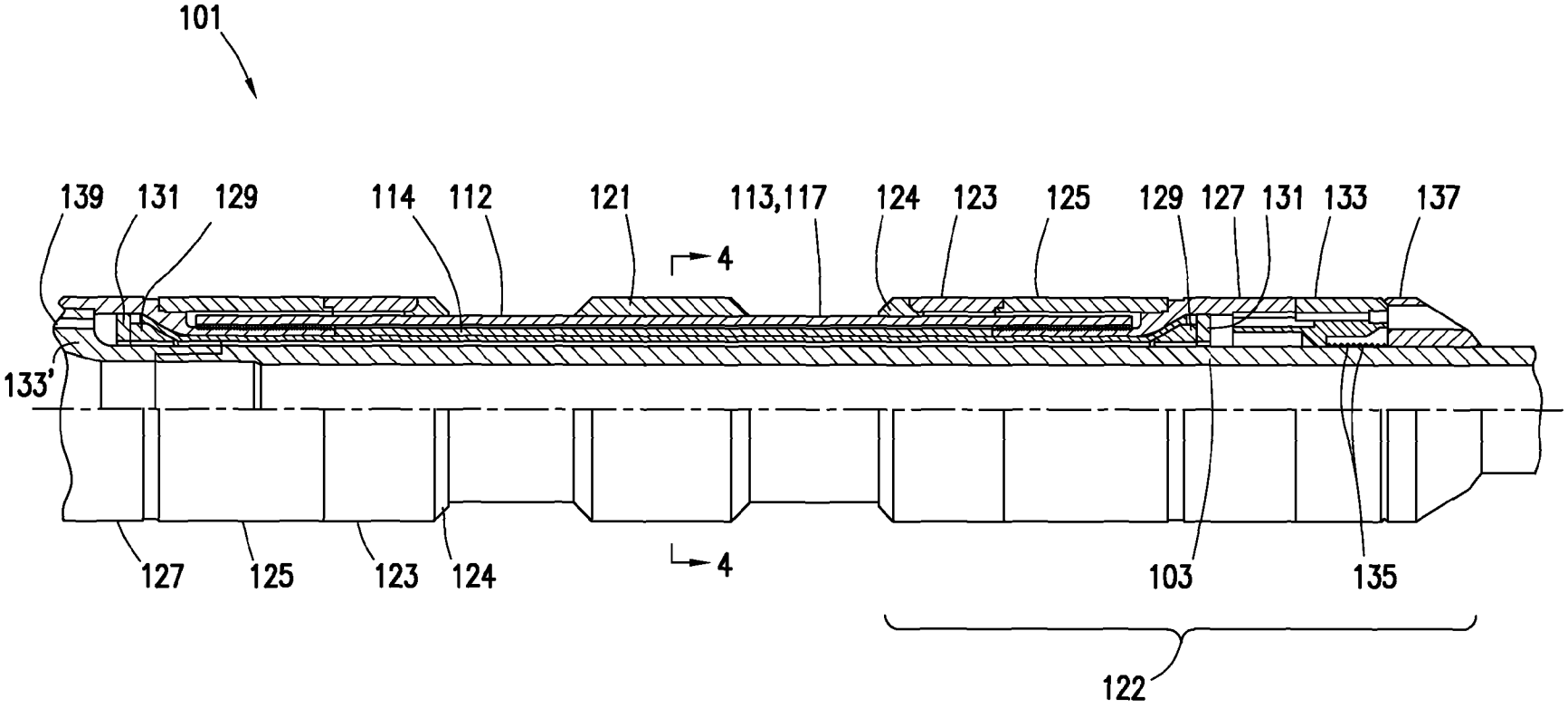
FIG. 2 depicts a partial cross section view of a cable wrapped inflatable packer element consistent with embodiments of the present disclosure.
Figure 3:
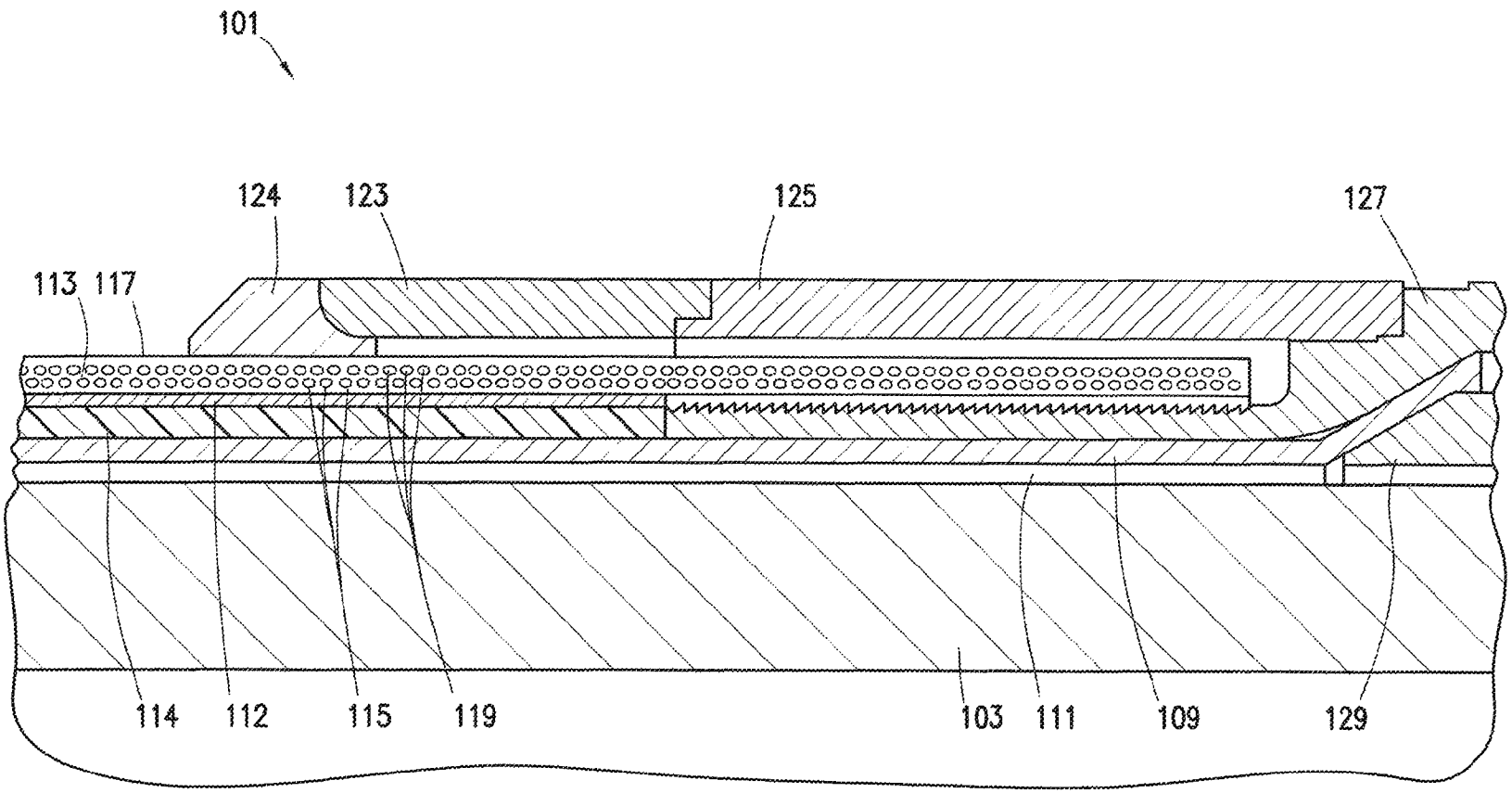
FIG. 3 depicts a detail view of the cable wrapped inflatable packer element of FIG. 2.
Figure 4:
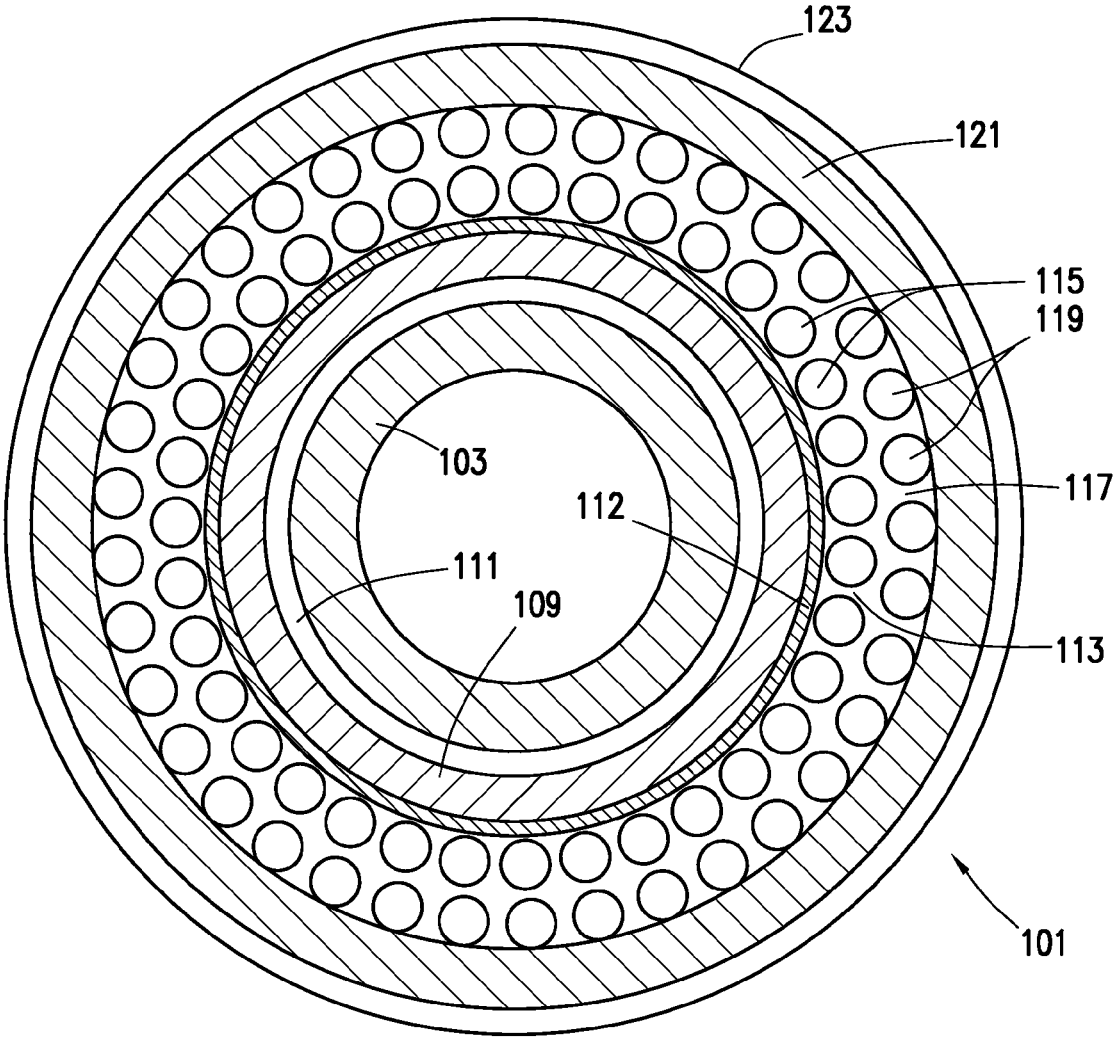
FIG. 4 depicts a lateral cross section view of the cable wrapped inflatable packer element of FIG. 2 at line 4-4.

In some embodiments, bladder 109 is surrounded by a plurality of slats 112. Slats 112 may be relatively thin strips of metal positioned in an overlapping arrangement about bladder 109 as depicted in FIG. 1A. In some embodiments, as depicted in FIGS. 2, 3, boot 114 may be positioned between bladder 109 and slats 112. Slats 112 may be coupled to each other by, for example, welding.

In some embodiments, slats 112 are surrounded by inner cable wrap layer 113. Inner cable wrap layer 113 includes a plurality of inner cables 115 wrapped around bladder 109. In some embodiments, inner cables 115 may be laid in parallel about the perimeter of bladder 109. In some embodiments, inner cables 115 may be positioned helically about bladder 109. In some embodiments, the angle between inner cables 115 and a longitudinal line along the length of bladder 109 may be approximately 5 to 30°. In some embodiments, the angle between inner cables 115 and the longitudinal line along the length of bladder 109 may be approximately 15°. Inner cables 115 are positioned to cover substantially the entirety of the outer surface of bladder 109. Depending on the diameter of inner cables 115, the number of inner cables 115 may vary to fully cover bladder 109. In some embodiments, the diameter of inner cables 115 may be approximately 1/32" to 1/2". In some embodiments, the diameter of inner cables 115 may be approximately 1/8". In some embodiments, the diameter of inner cables 115 may be approximately 3/32".

In some embodiments, inner cable wrap layer 113 is surrounded by outer cable wrap layer 117. Outer cable wrap layer 117 includes a plurality of outer cables 119 wrapped around inner cable wrap layer 113. In some embodiments, outer cables 119 may be laid in parallel about the perimeter of inner cable wrap layer 113. Outer cables 119 may be laid so that they wrap around inner cable wrap layer 113 in the opposite direction as cables 115 wrap about bladder 109. As such, in some embodiments, the angle between outer cables 119 and the longitudinal line along the length of bladder 109 is approximately −5 to −30°. In some embodiments, the angle between outer cables 119 and the longitudinal line along the length of bladder 109 may be approximately −15°. Outer cables 119 are positioned to cover substantially the entirety of the outer surface of inner cable wrap layer 113. Depending on the diameter of outer cables 119, the number of outer cables 119 may vary to fully cover inner cable wrap layer 113. In some embodiments, the diameter of outer cables 119 may be approximately 1/32" to 1/2". In some embodiments, the diameter of outer cables 119 may be approximately 1/8". In some embodiments, the diameter of outer cables 119 may be approximately 3/32".

Inner cables 115 and outer cables 119 are positioned so that as bladder 109 increases in diameter as previously discussed, inner and outer cables 115, 119 likewise extend radially. In some embodiments, inner and outer cables 115, 119 may, for example, increase the rigidity and resilience of bladder 109 allowing, for example, larger pressures to be used to inflate bladder 109. In some embodiments, outer cables 119 may be positioned to directly engage the surrounding wellbore or tubular when inflated. In some embodiments, outer cables 119 may be formed from a material which, when forced against the surrounding wellbore or tubular, elastically or plastically deform to form a fluid seal between inflatable packer 101 and the surrounding wellbore or tubular.

In some embodiments, as depicted in FIGS. 1-4, at least a portion of outer cable wrap layer 117 may be surrounded by outer cover 121. In some embodiments, as depicted in FIG. 1, outer cover 121 may surround the entirety of outer cable wrap layer 117. In some embodiments, as depicted in FIGS. 2, 3, outer cover 121 may surround only a portion of outer cable wrap layer 117. Outer cover 121 may be formed from an elastomeric material. Outer cover 121 may likewise expand radially as bladder 109 increases in diameter. Outer cover 121 may be positioned to enhance the fluid sealing capacity of inflatable packer 101 by, for example, increasing the contact surface between inflatable packer 101 and the surrounding wellbore or tubular. Additionally, where outer cover 121 is formed from an elastomeric material and inner and outer cables 115, 119 are formed from a metal, the generally lower Young's Modulus of elastomers may allow outer cover 121 to more readily conform to any surface irregularities of the surrounding wellbore or tubular.

In some embodiments, end sub 122 is positioned to couple bladder 109, inner cable wrap layer 113, outer cable wrap layer 115, and (if included) outer cover 121 to mandrel 103. In some embodiments of the present disclosure, end sub 122 may include stress ring 123 at each end of inflatable packer 101. As depicted in FIGS. 2, 3, stress ring 123 may be positioned about bladder 109, inner cable wrap layer 113, outer cable wrap layer 117, and (if included) outer cover 121. In embodiments in which outer cover 121 does not fully surround outer cable wrap layer 115, an elastomeric gasket 124 may be positioned between stress ring 123 and outer cable wrap layer 117. Stress ring 123 and elastomeric gasket 124 may, when inflatable packer 101 is inflated, serve to, for example, reduce or prevent bladder 109, slats 112, inner cable wrap layer 113, and outer cable wrap layer 117 from bending too sharply and possibly causing material failure from associated stress concentrations. In some embodiments, end sub 122 may further include sleeve 125 and seal housing 127. Stress ring 123 may be coupled to sleeve 125. Sleeve 125 may be coupled to seal housing 127. Sleeve 125 is positioned to surround inner and outer cable wrap layers 113, 117. In some embodiments, sleeve 125 may be positioned to compress inner and outer cable wrap layers 113, 117 between sleeve 125 and seal housing 127. In other embodiments, the space between sleeve 125 and seal housing 127 which contains inner and outer cable wrap layers 113, 117, may be filled by a potting material such as, for example and without limitation, epoxy resin.

In some embodiments, seal housing 127 is positioned tightly around the outer diameter of bladder 109. In some embodiments, seal ring 129 may be inserted into the end of seal housing 127 and positioned to compress bladder 109 against seal housing 127. In some embodiments, lock ring 131 may be positioned to retain and supply the compressive force against seal ring 129.

In some embodiments, seal housing 127 is coupled directly to mandrel 103. In other embodiments, seal housing 127 is coupled to connection sub 133, 133' by, for example and without limitation, a threaded connection or by epoxy resin. As depicted in FIG. 2, in some embodiments, one or more seals 135 may be positioned between connection sub 133 and mandrel 103. In some embodiments, end cap 137 may be positioned on the end of connection sub 133. In some embodiments, each end of inflatable packer 101 may utilize a different type of connection sub 133, 133'.

For example, connection sub 133' may, in some embodiments, include one or more ports 139 positioned to supply fluid to interior cavity 111 to allow inflatable packer 101 to inflate. In some embodiments, port 139 may be coupled to a valve assembly (not shown) positioned to allow or prevent fluid from flowing into interior cavity 111.

In order to form inflatable packer 101, in some embodiments, the components of inflatable packer 101 may be built up directly onto mandrel 103. In other embodiments, a subassembly of inflatable packer 101 including slats 112, inner and outer cable wrapped layers 113, 117, and outer cover 121 may be assembled on a temporary forming mandrel. The temporary forming mandrel may have an outer diameter equal to that of bladder 109. Boot 114 may be placed onto the temporary forming mandrel to, for example, allow the completed inflatable packer subassembly to be removed from the temporary forming mandrel. Slats 112 may then be positioned about boot 114 and coupled to each other by, for example, welding. Inner cables 115 may then be wrapped about slats 112 to form inner cable wrapped layer 113. Outer cables 119 may then be wrapped about inner cable wrapped layer 113 to form outer cable wrapped layer 117.

For each end of the inflatable packer subassembly, an end sub 122, which may include seal housing 127, sleeve 125, and stress ring 123, may then be assembled and positioned onto the temporary forming mandrel in the position previously described relative to inner and outer cable wrapped layers 113, 117. Seal housing 127, sleeve 125, and stress ring 123 may, in some embodiments, then be coupled to inner and outer cable wrapped layers 113, 117, slats 112, and/or boot 114 by, for example, the injection of epoxy resin into the spaces therebetween. In some embodiments, the inflatable packer subassembly may then be put under tension to, for example, pre-stress inner and outer cables 115, 119, or to stretch the inflatable packer subassembly to a specified length. In some embodiments, outer cover 121 may be applied to outer cable wrap layer 117. In some embodiments, outer cover 121 may be formed by wrapping, injection molding, etc.

The inflatable packer subassembly may then be removed from the temporary forming mandrel, bladder 109 may be inserted into the interior of inflatable packer subassembly and attached thereto by, for example seal and lock rings 129, 131. The now complete inflatable packer subassembly, also known as an inflatable packer element, may then be positioned about mandrel 103, and joined thereto by, for example, connection subs 133, 133'.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An inflatable packer for use in a wellbore, the inflatable packer comprising:

a mandrel, the mandrel being generally tubular about an axis;

a bladder, the bladder being generally tubular and formed from an elastomer, the bladder positioned about the mandrel and forming a space between the mandrel and the bladder defining the interior of the inflatable packer;

a slat layer, the slat layer including a plurality of slats overlapping about the outer surface of the bladder;

an inner cable wrapped layer, the inner cable wrapped layer including a plurality of inner cables wrapped around the slat layer;

an outer cable wrapped layer, the outer cable wrapped layer including a plurality of outer cables wrapped around the outer diameter of the inner cable wrapped layer;

an end sub positioned at each end of the bladder, inner cable wrapped layer, and outer cable wrapped layer, the end sub positioned to couple each of the bladder, inner cable wrapped layer, and outer cable wrapped layer to the mandrel, the end sub including a seal housing and seal ring, the seal housing positioned about the bladder, the seal ring positioned to compress the bladder against the seal housing, and a lock ring positioned to retain and compress the seal ring against the bladder.

2. The inflatable packer of claim 1, wherein the slats comprise generally thin strips of metal.

3. The inflatable packer of claim 1, wherein the slats are positioned generally parallel.

4. The inflatable packer of claim 1, wherein the inner cables are wrapped generally parallel to each other.

5. The inflatable packer of claim 1, wherein the outer cables are wrapped generally parallel to each other.

6. The inflatable packer of claim 1, wherein the end sub further comprises a stress ring positioned about the bladder, inner cable wrapped layer, and outer cable wrapped layer.

7. The inflatable packer of claim 1, further comprising a connection sub, the connection sub positioned to fluidly seal between the interior of the inflatable packer and the mandrel at the end of the bladder.

8. The inflatable packer of claim 7, wherein the connection sub further comprises at least one port positioned to supply fluid to the interior of the inflatable packer.

9. The inflatable packer of claim 1, wherein the mandrel further comprises a coupling at an end of the mandrel positioned to couple the mandrel to an adjacent tubular member.

10. The inflatable packer of claim 1, wherein the inner cables are helically wrapped about the bladder in a first direction, and the outer cables are helically wrapped about the inner cable wrapped layer in the opposite direction.

11. The inflatable packer of claim 10, wherein the angle between a line parallel with the axis of the mandrel along the outer surface of the bladder and each of the inner cables is approximately 5 to 30°, and the angle between the line and each of the outer cables is approximately −5 to −30°.

12. The inflatable packer of claim 10, wherein the angle between a line parallel with the axis of the mandrel along the outer surface of the bladder and each of the inner cables is approximately 15°, and the angle between the line and each of the outer cables is approximately −15°.

13. The inflatable packer of claim 1, wherein at least a portion of the outer cable wrapped layer is surrounded by an outer cover, the outer cover being generally tubular and formed from an elastomer.

14. A method of manufacturing an inflatable packer element for use in a wellbore, the method comprising:

providing a generally tubular temporary forming mandrel, the temporary forming mandrel having an axis;

coupling a plurality of slats about the temporary forming mandrel, the slats being generally thin strips of metal, the slats positioned generally parallel and overlapping about the outer surface of the temporary forming mandrel;

wrapping a plurality of inner cables about the slats to form an inner cable wrapped layer, the inner cables wrapped generally helically and parallel to each other and at a first angle relative to the axis of the temporary forming mandrel;

wrapping a plurality of outer cables about the inner cable wrapped layer to form an outer cable wrapped layer, the outer cables wrapped generally helically and parallel to each other and at a second angle relative to the axis of the temporary forming mandrel, the second angle being generally the opposite of the first angle;

positioning an end sub about each end of the inflatable packer element;

coupling the end sub to the slats, inner cable wrapped layer, and outer cable wrapped layer;

removing the temporary forming mandrel;

positioning a bladder within the slats, the bladder being a generally tubular elastomer;

sealing the bladder to the end sub by a seal ring held in place by a lock ring.

15. The method of claim 14, wherein the end sub is coupled to the slats, inner cable wrapped layer, and outer cable wrapped layer by injecting epoxy resin into the space therebetween.

16. The method of claim 14, wherein the first angle is approximately 5 to 30°, and the second angle is approximately −5 to −30°.

17. The method of claim 14, wherein the first angle is approximately 15°, and the second angle is approximately −15°.

18. The method of claim 14, further comprising:

forming a generally tubular, elastomeric outer cover about the outer cable wrapped layer.

* * * * *